US010851602B2

(12) United States Patent
Chitwood

(10) Patent No.: US 10,851,602 B2
(45) Date of Patent: Dec. 1, 2020

(54) SWIVEL CONNECTION TOOL

(71) Applicant: Jerry Chitwood, Rock Springs, WY (US)

(72) Inventor: Jerry Chitwood, Rock Springs, WY (US)

( * ) Notice: Subject to any disclaimer, the term of this patent is extended or adjusted under 35 U.S.C. 154(b) by 78 days.

(21) Appl. No.: 16/171,653

(22) Filed: Oct. 26, 2018

(65) Prior Publication Data

US 2020/0131866 A1 Apr. 30, 2020

(51) Int. Cl.
*E21B 19/16* (2006.01)
*E21B 19/15* (2006.01)

(52) U.S. Cl.
CPC ..... *E21B 19/161* (2013.01); *E21B 19/155* (2013.01); *E21B 19/163* (2013.01)

(58) Field of Classification Search
CPC ..... E21B 19/161; E21B 19/163; E21B 19/16; E21B 19/155
See application file for complete search history.

(56) References Cited

U.S. PATENT DOCUMENTS 2,705,645 A * 4/1955 Adams ..... E21B 19/155 280/47.131
4,269,554 A * 5/1981 Jackson ..... E21B 19/14 294/102.2
4,274,778 A * 6/1981 Putnam ..... B25J 9/0084 175/85
4,832,552 A * 5/1989 Skelly ..... E21B 3/02 173/164
7,552,775 B2 * 6/2009 Pietras ..... E21B 19/155 166/380
8,281,877 B2 * 10/2012 Shahin ..... E21B 7/20 175/162
8,985,201 B2 * 3/2015 Begnaud ..... E21B 19/08 166/77.51
9,175,527 B2 * 11/2015 McIntosh ..... E21B 19/06
9,500,049 B1 * 11/2016 Orgeron ..... E21B 19/155
2007/0169930 A1 * 7/2007 Shahin ..... E21B 7/20 166/77.52
2019/0003271 A1 * 1/2019 Clarke ..... E21B 19/155

* cited by examiner

*Primary Examiner* — Nicole Coy

(74) *Attorney, Agent, or Firm* — Thorpe, North & Western, LLP

(57) ABSTRACT

A swivel connection tool holds a tubular of a work string or a drill string while a swivel connects or disconnects from the tubular. The swivel connection tool has a base mounted to a work floor of a derrick of a workover rig. The swivel connection tool is fixed spaced-apart from a hole in the work floor positioned over the wellhead. The swivel connection tool has a yoke oriented at an incline with respect to horizontal.

18 Claims, 3 Drawing Sheets

150

32
158
18
154
14
46
10
26
162
34
30
142
42
38
22
146

SWIVEL CONNECTION TOOL

BACKGROUND

A workover rig raises and lowers a workstring in an oil or gas well while personnel add and remove tubulars between the workstring and the overhead swivel. Adjacent tubulars are connected by pipe threads at joints between the tubulars. Making-up involves forming the joint or threading one tubular to another, while breaking-up involves unthreading the joint. The joints are typically torqued-up to a significant predetermined torque design to maintain the connection. Such threading and torqueing can be accomplished with a power swivel. Typically, personnel hold the tubular with a large pipe wrench while a power swivel breaks the torqued joint, or makes the joint. Holding the pipe wrench is jarring and can be dangerous if the wrench is thrown or breaks. In addition, manually holding the tubular can be dangerous due to burs on the tubulars catching clothing while being rotated by the swivel.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
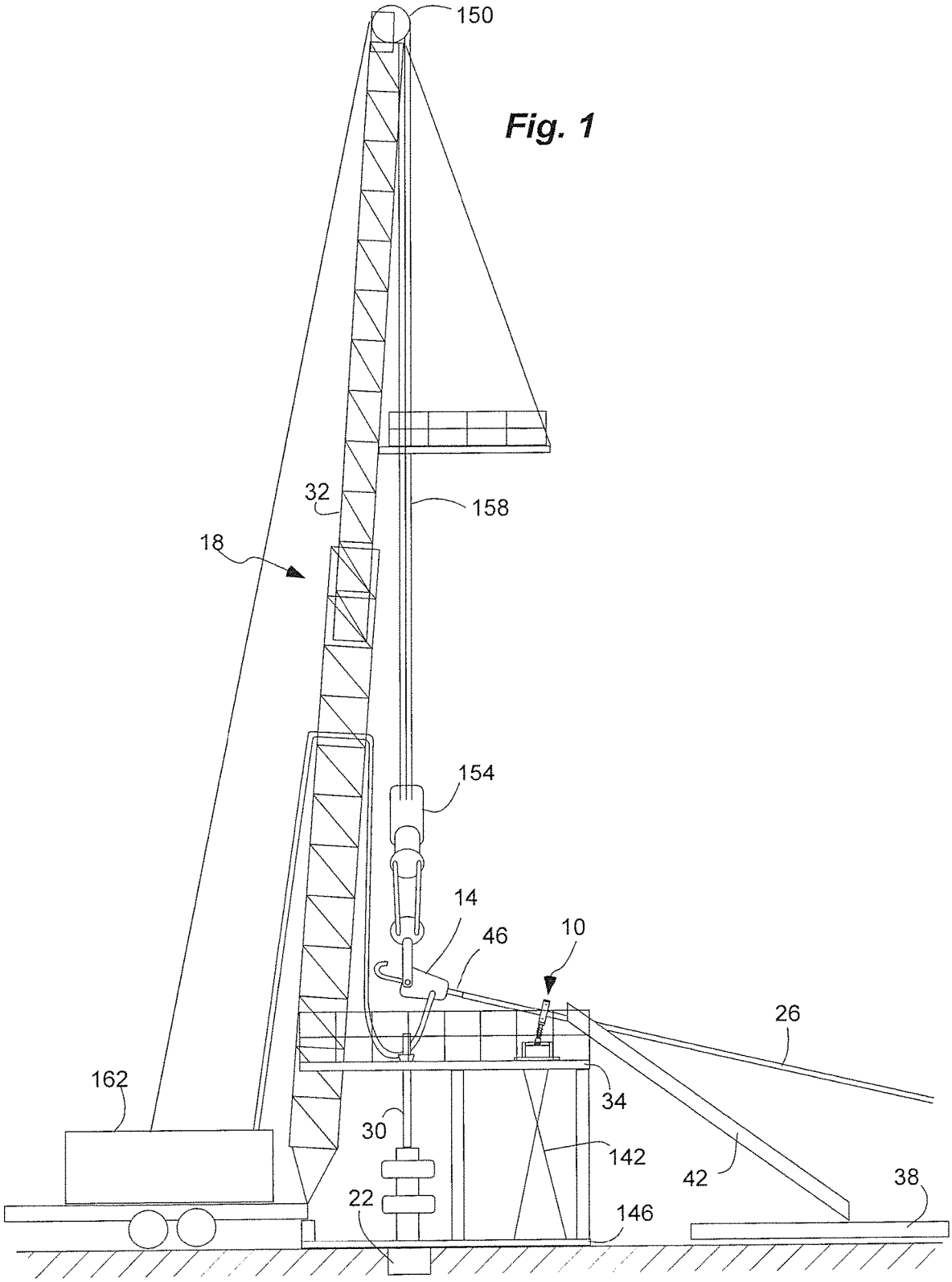
FIG. 1 is a schematic side view of a work over rig with a swivel connection tool in accordance with an embodiment of the invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "workover rig" is used to refer to a rig used to service an existing well, subsequent to drilling the well by a drilling rig. While a drilling rig can be used to drill the well, fracture (frac) the pipe, and set wirelines and plugs, a workover rig is erected after the drilling rig has been removed. The workover rig can be erected adjacent to and/or over the wellhead, Christmas tree, and/or blow-out-preventer (BOP). A workover rig is typically used to perform clean out of an existing well, and drillout of plugs in an existing well. A workover rig can be mobile and mounted on a vehicle, such as a truck. The workover rig is adapted to handle tubbing or tubulars of a work string or drill string that extend from the surface (i.e. the workover rig) and into the well, and the existing well casing. Thus, the workover rig can run in and/or run out the work string or drill string. The end of the work string can have a mud motor and bit to drill out plugs set in the well.

As used herein, the terms "tubulars" and "tubing" are used interchangeably to refer to individual tubes or pipes that make-up the work string or the drill string. The tubulars are lengths of pipe having threaded connections, such as female threads at a top of the tubular, and male threads at a bottom of the tubular. The threaded connections of adjacent pipes are threaded together to form a connection. Such threaded connection are usually torqued-up to a predetermined torque, e.g. as much as 1,800 ft-lbs or 3,600 ft-lbs to as much as 15,000 ft-lbs.

As used herein, the term "swivel" is used to refer to a device that supports and turns a tubular in making a connection or a disconnection between adjacent tubulars. In addition, the swivel can support the weight of the work string or drill string, and is capable of rotating, or allowing rotation of, the work string as a whole, and/or is capable of rotating the uppermost tubular to make-up or break-out connections with respect to the lower adjacent tubular. Thus, the swivel can be a power swivel, and can rotate the work string or drill string, or can include a topdrive to rotate the work string. The swivel can make connections to the tubulars. The swivel may include a stem with a valve to resist back-flow and/or to provide an emergency stop valve that can be used in conjunction with the BOP. In addition, the swivel may include a cross-over between the swivel or the stem and the valve, and the tubular. The cross-over can have a threaded connection to mate with the threaded connection of the tubular.

As used herein, the terms "make-up" or "making-up" are used to refer to connecting or tightening threaded connections or joints between tubulars, or tubulars and tools.

As used here, the terms "torque-up" or "torqueing-up" are used to refer to applying a predetermined torque to a threaded connection or joint between tubulars, or tubulars and tools. In one aspect, the threaded connections or joints can be torqued to at least 1,800 ft-lbs. In another aspect, the threaded connections or joints can be torqued to at least 3,600 ft-lbs. In another aspect, the threaded connections or joints can be torqued to as much as 15,000 ft-lbs.

As used herein, the terms "break-out" or "breaking-out" are used to refer to unscrewing or untightening or disconnecting a threaded connection or joint between tubulars, or tubulars and tools.

As used herein, the terms "work floor" and "rig floor" and "derrick floor" are used interchangeably to refer to a platform upon which a crew stands and a work area upon which a crew works, including to add and remove tubulars from the work sting. The area immediately above the work floor is where connections between adjacent tubulars, or between a tubular and the swivel, are made-up or broken-out. The work floor can have an opening in the floor through which the work string or drill string extends from the derrick and into the well. The opening can be positioned over the wellhead, the Christmas tree, and/or the BOP. The opening can receive slips to grip the work string and suspend the work string from the work floor while connections or joints are being made-up or broke-out. The work floor can be elevated over the wellhead and above the support surface or ground. The work floor can also be elevated with respect to the catwalk which receives and stages tubulars.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

A swivel connection tool is presented to facilitate connecting and/or disconnecting tubulars from a swivel. The tubulars can be added or removed from a work string or a drill string extending into a well. Such work strings or drill strings are made from lengths (~30 ft) of tubulars or pipe threaded together sequentially. The tubulars can be heavy (~400 lbs) and can be threaded together and torqued (~1,800 ft-lbs, 3,600 ft-lbs+). Thus, handling the tubulars and making-up and subsequently breaking-down the connections can be difficult and dangerous. As described above, a worker typically holds the tubular from rotating with a large pipe wrench while the swivel connects to, or disconnects from, the tubular. Holding a pipe wrench during connections or disconnections, or during torqueing, can be jarring. On occasion, a pipe wrench can break and injure personnel. The swivel connection tool, however, can hold the tubular from rotating while the swivel turns to connect or disconnect to the tubular. The swivel connection tool removes personnel from immediate vicinity of the tubular and the swivel while connections are being made or broken, or torqued. Personnel can sometimes be tempted to hold the tubular during connection, increasing the danger of burrs on the tubular catching on clothing. The swivel connection tool, however, can support the tubular during connection and disconnection.

Figure 2:
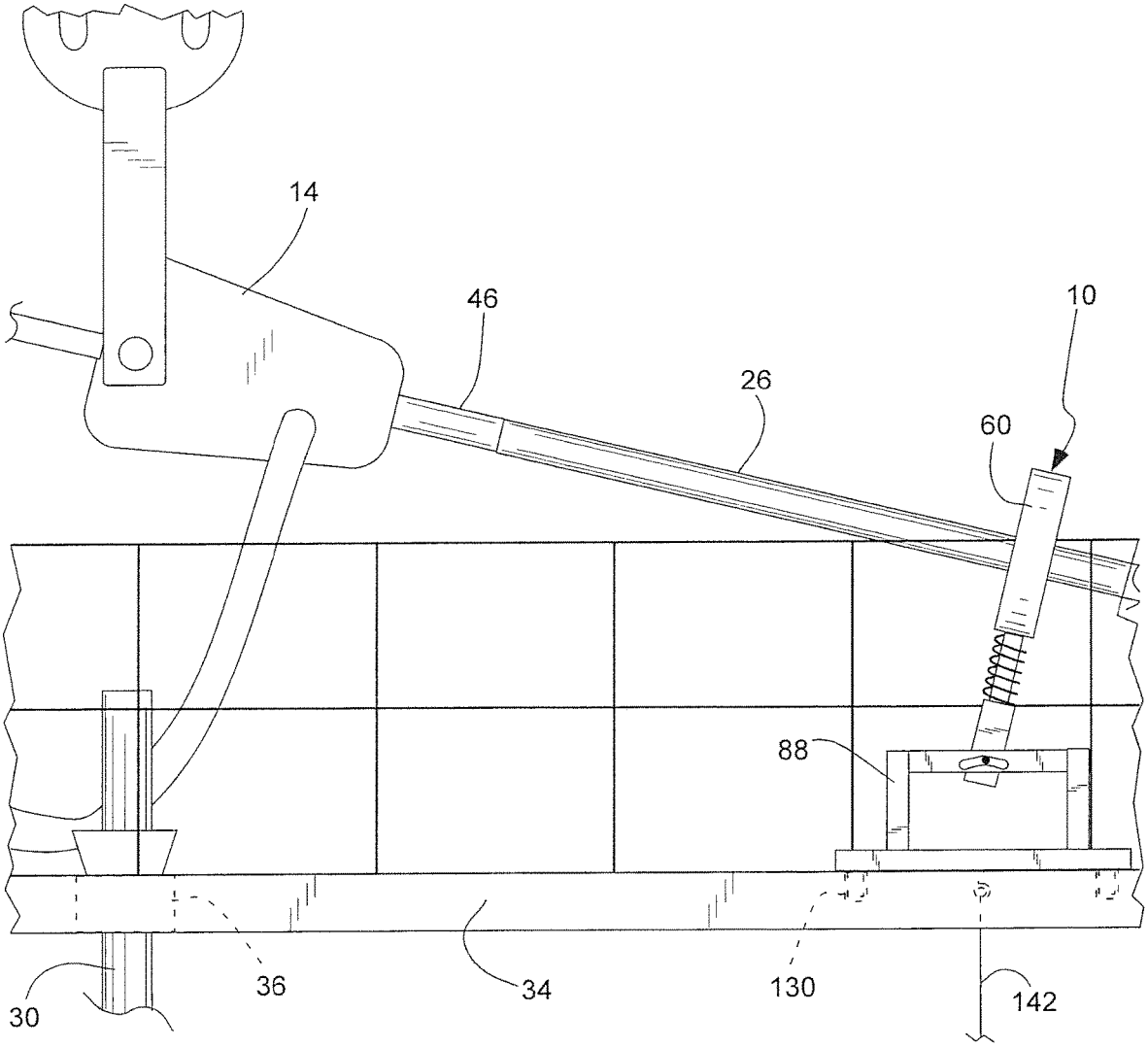
FIG. 2 is a partial schematic side view of a work floor of the work over rig with the swivel connection tool of FIG. 1.
Figure 4:
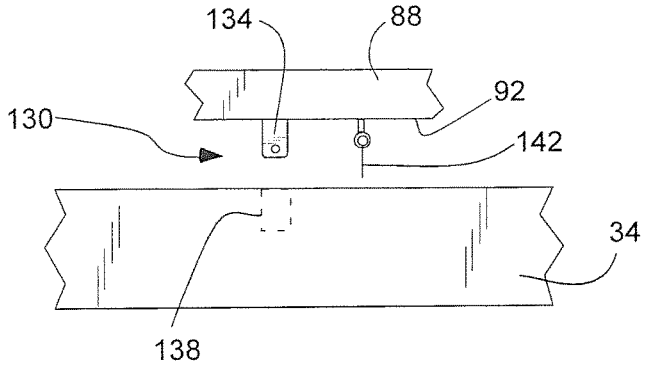
FIG. 4 is a partial schematic side view of the swivel connection tool of FIG. 1 and the work floor.
Figure 3:
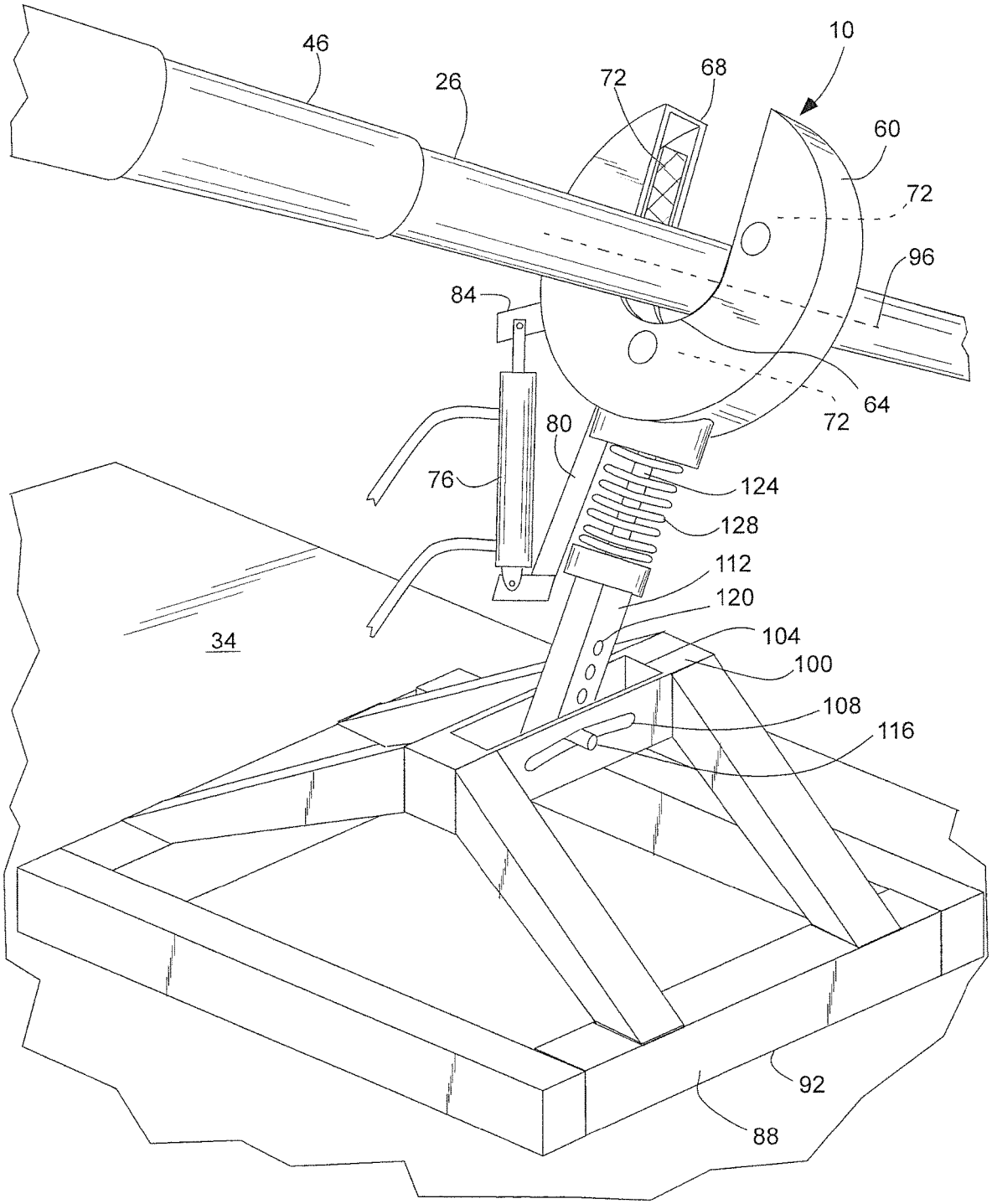
FIG. 3 is a perspective view of the swivel connection tool of FIG. 1 on a work floor of a work over rig.

Referring to FIGS. 1-4, one example of a swivel connection tool 10 is shown in use with a swivel 14 of a workover rig 18. The workover rig 18 can be located adjacent a well or wellhead 22, and disposed on a support surface such as the ground. The wellhead 22 can include a Christmas tree and/or a blow-out-preventer (BOP). The swivel connection tool 10 can be used in connecting or disconnecting a tubular 26 of a work string 30 or drill string to the swivel 14. The work string 30 or the drill string can extend into or out of the wellhead 22. The work over rig 18 can have a derrick 32 with an elevated work floor 34 located adjacent the derrick and over the wellhead 22. The work floor 34 can be supported by the derrick 32, and/or disposed on the support surface or ground. The work floor 34 can have an opening 36 that can be aligned with the wellhead 22 and can be capable of receiving the tubulars 26 and/or the work string 30 therethrough. A catwalk 38 can be located on the support surface adjacent to the work floor 34 with a slide or chute 42 extending from the work floor 34 to the catwalk and capable of transporting tubulars 26 between the work floor and the catwalk.

The swivel 14 can be carried by the derrick 32 and suspended over the work floor 34. In one aspect, the swivel can be suspended from the derrick 32. The swivel 14 can be capable of being raised and lowered by the derrick 32 to raise and lower the work string 30, and to raise and lower tubulars 26 to extend and reduce the length of the work string 30. Thus, the swivel 14 is capable of being selectively and releasably coupled to a tubular 26, and the work string 30. The swivel 14 can rotate the work string 30 in the well. In addition, the swivel 14 is capable of rotating the tubular 26 when connecting or disconnecting to the work string 30. In addition, the swivel 14 can be used in making-up and breaking-down connections or joints between adjacent tubulars. In one aspect, the swivel 14 can be a power swivel.

The tubulars 26 can be provided from, and returned to, the catwalk 38. Thus, the tubulars 26 can be oriented at an incline with respect to horizontal when supported by the catwalk 38 and the work floor 34 or the swivel connection tool 10 thereon. In one aspect, the tubulars 26 can be oriented between 10-30 degrees with respect to horizontal between the work floor 34 and the catwalk 38 when being connected and disconnected from the swivel 14. The swivel 14 can be pivotal with respect to the derrick 32 between vertical and inclined with respect to horizontal. Thus, the swivel 14 can align with the tubular 26 from the catwalk 38 during connection and disconnection with the tubular 26. The swivel 14 can have a threaded connection 46 to mate with the threaded connection of the tubular 26. The swivel 14 may include a stem with a valve to resist back-flow and/or to provide an emergency stop valve that can be used in conjunction with the BOP. In addition, the swivel 14 may include a cross-over between the swivel 14 or the stem and the valve, and the tubular 26.

The swivel 14 and the swivel connection tool 10 can be used to repeatedly add and remove tubulars 26 with respect to the work string 30 or the drill string. When running the work string 30 into the well and extending the work string, the swivel 14 can connect, with its connection 46, to a tubular 26 from the catwalk 38, raise the tubular 26 to a vertical orientation over the work string 30, and connect the bottom of the tubular 26 to the top of the work string 30. The swivel connection 46 can form a torqued connection to the tubular 26 to resist inadvertent unthreading or disconnection while being handled above the work floor 34. When pulling the work string 30 from the well and shortening the work string, the swivel 14 can raise the work string 30 with the tubular 26 above the work floor 34, disconnect or unthread the bottom of the tubular 26 from the top of the work string 30, lower the tubular 26 down the slide 42 to the catwalk 38, and disconnect or unthread from the tubular 26. Again, disconnecting from the tubular 26 can require breaking a torqued connection.

The swivel connection tool 10 can be located on and mounted to the work floor 34 to hold and support the tubular 26 while the swivel 14 connects and disconnects, or threads and unthreads. The swivel connection tool 10 can comprise a yoke 60 with a bore 64 therethrough sized and shaped to receive the tubular 26. In addition, the yoke 60 has an opening 68 from a perimeter of the yoke 60 to the bore 64. The opening 68 is sized to receive the tubular 26 through the opening and into the bore 64. Jaws 72 are carried by the yoke 60 can be movably disposed in the yoke 60 and movable with respect to the bore 64, and thus the tubular 26. The jaws 72 can be pivotal with respect to the bore 64, and thus the tubular 26, between an open position and a tight position. In the open position, the jaws 72 are further from the bore 64, and can be disposed in the yoke 60. In the tight position, the jaws 72 are closer to the bore 64, and thus the tubular 26, to hold the tubular 26 in the bore 64 and resist rotation of the tubular 26 in the bore 64. The jaws 72 can have teeth to engage the tubular 26. In one aspect, three jaws 72 can be located around the bore 64 and can pivot in the tight position to extend substantially around the tubular 26.

An actuator 76 can be carried by the yoke 60 and operatively coupled to the jaws 72. The actuator 76 can pivot the jaws 72 between the open position and the tight position. In one aspect, the actuator can be a pneumatic or hydraulic piston. The actuator 76 can extend between a brace 80 affixed to the yoke 60, and a lever arm 84 operatively coupled to the jaws 72.

The yoke 60 can be carried by a base 88, which in turn can be carried by the work floor 34. As described above, the work floor 34 can be carried by the derrick and/or disposed on the support surface or ground. The base 88 can have a bottom or bottom surface 92 adapted to match the work floor 34. In one aspect, the work floor 34 can be flat or substantially flat, while the bottom surface 92 of the base 88 can be flat or substantially flat to match the work floor 34. The yoke 60 is oriented at an incline on and with respect to the base 88 or bottom surface 92 thereof, and thus with respect to the work floor 34. A bore axis 96 of the bore 64 of the yoke 60 can be oriented at an acute angle with respect to horizontal, and thus the bottom surface 88 and the work floor 34 when in use. The bore axis 96 of the yoke 60 can be oriented at an angle with respect to horizontal, or the bottom surface 92 of the base 88, between 10-30 degrees in one aspect, between 15-20 degrees in another aspect, less than 45 degrees in another aspect, less than 30 degrees in another aspect, and less than 20 degrees in another aspect. Thus, the swivel connection tool 10 can accommodate and help make connections and disconnection between the tubular 26 and the swivel 14 while the tubular is supported between the catwalk 38 and the work floor 34, or the swivel connection tool 10 thereon.

In one aspect, the base 88 can have a footprint or size that is larger than the yoke 60. Thus, the base 88 can have a width and a length that are larger than the yoke 60. The width and length of the base 88 can resist tipping of the swivel connection tool 10 during use, and/or can reduce torque on the work floor 34 during use.

The base 88 can comprise a beam 100 oriented substantially horizontally and extending fore and aft. In one aspect, the beam 100 can be elevated with respect to the bottom surface 92 of the base 88 and the work floor 34. In another aspect, the beam 100 can be aligned with the bore axis 96 of the yoke 60, and with the tubular 26. In one aspect, the yoke 60 can be movably coupled to the base 88. The beam 100 can have a vertical slot 104 therein, and a horizontal slot 108 transverse to and intersecting the vertical slot 104. The vertical slot 104 can be straight, while the horizontal slot 108 can be arcuate with a concave shape facing downwardly. The swivel connection tool 10 can comprise an arm 112 coupled between the base 88 and the yoke 60. The horizontal slot 104 can receive the arm 112 therein. A pin 116 can extend through the horizontal slot 108, the vertical slot 104, and the arm 112 to hold the arm 112, and thus the yoke 60, on the base 88. The vertical and horizontal slots 104 and 108 can be elongated so that the arm 112 and the pin 116 can move in the respective slot. The yoke 66 can move or heave or surge, towards and away from the base 88, with respect to the base and the work floor 34 with the arm 112 moving in the vertical slot 104 during use to accommodate movement of the tubular 26 and forces exerted by the swivel 14. The pin 116 can displace in the horizontal slot 108 to allow the heave or surge movement of the arm 112 and the yoke 60. The fore and aft movement of the arm 112 and the yoke 66 with respect to the base 88 and the work floor 34 provides at least one degree of freedom. In addition, the arm 112 can pivot or can pitch about the pin 116 in the vertical slot 104 to achieve a desired orientation of the yoke 60, and a desired orientation of the bore axis 96. The arm 112 and the yoke 60 pitching or tilting in the fore and aft direction, or forward and backward, with respect to the base 88 and the work floor 34 provides another degree of freedom. Furthermore, the arm 112 can have array of holes 120 along its length and the pin 116 can be selectively received in one of the holes 120 to determine an elevation of the yoke 60 with respect to the base 88 and the work floor 34.

The swivel connection tool 10 can further comprise a spindle 124 extending from the yoke 60 and coupled to the base 88 by the arm 112. Thus, the spindle 124 can be connected to, and can extend between, the arm 112 and the yoke 60. The spindle 124 can move longitudinally with respect to the arm 112. Thus, the yoke 60 can move towards and away from the base 88 along the axis of the spindle 124 and/or the arm 112. A spring 128, such as a coil spring, can extending between the yoke 60 and the base 88 or the arm 112. The spring 128 can coil around, and thus be carried by, the spindle 124. The spring 128 can be disposed between a collar on the arm 112 and a collar of the yoke 60. The spring 128 can bias the yoke 60 away from the base 88, and can act as a shock absorber when the tubular 26 is placed into the yoke 60. The spring 128 can bias the yoke 60 to a rest position. Thus, the yoke 60 is movable towards and away from the base 88, and biased away from the base by the spring 128.

The spindle 124 and the arm 112, and the arm 112 and the beam 100 or the slot 104 of the base 88, can have some clearance and/or play therebetween to allow the yoke 60 to roll or tilt side to side with respect to the base 88. In one aspect, the spindle 124 can roll or tilt side to side with respect to the arm 112. In addition, the spindle 124 and the arm 112, and the arm 112 and the beam 100 or the slot 104 of the base 88, can have some clearance and/or play therebetween to allow the yoke 60 to yaw or turn left and right with respect to the base 88. In one aspect, the spindle 124, and thus the yoke 60, can turn left and right with respect to the arm 112. In another aspect, the yoke 60 can pivot on the spindle 124, about the longitudinal axis thereof, to allow yaw or turning left and right with respect to the base 88.

As described above, the yoke 60 can be movable and/pivotal with respect to the base 88, and thus the work floor 34, about at least one degree of freedom. In one aspect, the yoke 60 has multiple degrees of freedom. In another aspect, the yoke 60 can have at least three degrees of freedom. In another aspect, the yoke 60 can have at least four degrees of freedom. The degrees of freedom can include: 1) heave or surge, with the yoke 60 moving fore and aft, or towards and away from, the base 88; 2) pitch, with the yoke 60 tilting fore and aft, or forward and backward, with respect to the base 88; 3) roll, with the yoke 60 tilting side to side with respect to the base 88; and/or 4) yaw, with the yoke 60 turning left and right with respect to the base 88. The yoke 60 can have a rest or biased position with respect to the base 88.

As described above, the bore axis 96 of the swivel connection tool 10 can be oriented at an angle with respect to the base 88. Similarly, the yoke 60 can be oriented at an angle defined by a face thereof, or defined by an axis of the spindle 124 of the arm 112. Thus, the yoke 60 can be oriented at an angle with respect to vertical between 10-30 degrees in one aspect, between 15-20 degrees in another aspect, less than 45 degrees in another aspect, less than 30 degrees in another aspect, and less than 20 degrees in another aspect. Thus, the swivel connection tool 10 can accommodate and help make connections and disconnection between the tubular 26 and the swivel 14 while the tubular is supported between the catwalk 38 and the work floor 34, or the swivel connection tool 10 thereon.

As described above, the base 88 can be mounted to the work floor 34. The swivel connection tool 10, or the base 88 or the yoke 60 thereof, can be in a fixed position spaced-apart from opening 36 on the work floor 34. It has been discovered by the inventor that the work floor 34 of the derrick 32 provides sufficient support to the swivel connection tool 10, even under the forces and torques applied by the swivel 14. In one aspect, the swivel connection tool 10 can have a mount 130 carried by the base 88 and adapted to fix the base 88 to the work floor 34. The mount 130 can comprise a hitch 134 receivable in a receiver 138. The hitch 134 can be carried by one of the base 88 or the work floor 34, while the receiver 138 can be carried by the other of the base 88 or the work floor 34. In one aspect, the receiver 138 can be formed in the work floor 34, while the hitch 134 can extend from the bottom 92 of the base 88. A pin can hold the hitch 134 in the receiver 138. In another aspect, multiple mounts 130 or pairs of hitches and receivers 134 and 138 can mount the base 88 to the work floor 34. Thus, the swivel connection tool 10 can be removably coupled to the work floor 34 and the derrick 32. For further support and/or stability, the swivel connection tool 10 or the base 88 thereof can be secured by a cable or cables 142 to the basebeam 146 of the derrick 32.

Also as described above, the swivel connection tool 10 can be used with a work over rig 18 or a drill rig, and the work floor 34 can be part of the derrick 32 of the rig 18. In one aspect, the work over rig 18 and the derrick 32 can comprise a cable system with a pulley system or block-and-tack system with a drawworks to raise and lower the swivel 14 and the work string 30. In another aspect, the work over rig 18 and the derrick 32 can comprise a hydraulic system with a rack-and-pinion system to raise and lower the swivel 14 and the work string 30. By way of example, the work over rig 18 and the derrick 32 will be described with a cable system. A crown block 150 can be located at a top of the derrick 32. A traveling block 154 can be suspended from the crown block 150 by a cable 158. The crown and traveling blocks 150 and 154 can define a set of pulleys of a pulley system or block-and-tackle system. A drawworks 162 can be coupled to the cable 158, and can be capable of reeling in and reeling out the cable 158. The swivel 14 can be suspended from the traveling block 154. The swivel 14 is capable of being selectively and releasably coupled to tubular 26 of the work string 30 and rotating the tubular 26. The swivel 14 can be pivotal with respect to the traveling block 154 between vertical and inclined with respect to horizontal. Thus, the swivel 14 can pivot to connect to tubulars 26 from the catwalk 38. The swivel 14 can be capable of being raised and lowered by the blocks 150 and 154 and the drawworks 162. The work floor 34 can be adjacent the derrick 32, and can elevated with respect to the support surface or ground, and locatable over the wellhead 22. The catwalk 38 can be on the support surface or ground adjacent to the work floor 34 with the slide 42 extending from the work floor 34 to the catwalk 38 to transport tubulars 26 between the work floor 34 and the catwalk 38. The swivel connection tool 10 can be located adjacent to an upper end of the slide 42, and between the upper end of the slide 42 and the swivel 14 when the swivel is lowered.

In use, the tubular 26 can have an upper end in the bore 64 of the yoke 60, and elevated above a lower end of the tubular. In addition, the tubular 26 can extend laterally at an incline with respect to horizontal and the work floor 34. The jaws 72 of the yoke 60 can engage and grip the upper end of the tubular 26, and resist the upper end of the tubular from rotating with respect to the yoke 60 and the work floor 34. The swivel 14 can be lowered adjacent or proximal the work floor 34, and can be pivoted to orient the swivel at an inclined to engage the upper end of the tubular 26. The connection 46 of the swivel 14 can be rotated to engage or disengage with the threads of the tubular 26. The tubular 26 can then be released by the jaws 72 of the swivel connection tool 10.

A method for connecting or disconnecting a threaded connection between a tubular 26 and a swivel 14 can comprise: 1) laying an end of a tubular 26 in the bore 64 of the yoke 60 of the swivel connection tool 10; 2) gripping the end of the tubular 26 with the jaws 72 of the yoke 60 of the swivel connection tool 10; 3) pivoting the swivel 14 to align with the tubular 26; rotating an end connection 46 of the swivel 14 with respect to the end of the tubular 26 with the swivel 14; and releasing the end of the tubular 26 from the jaws 72 of the swivel connection tool 10. Rotating the end connection 46 of the swivel 14 can comprise breaking a torqued-up a connection between the swivel and the tubular. Rotating the end connection 46 of the swivel 14 can comprise torqueing-up a connection between the swivel 14 and the tubular 26 to a predetermined torque, such as greater than 1,800 ft-lbs or 3,600 ft-lbs.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A swivel connection tool in combination with a swivel with an end connection configured to be suspended over an elevated work floor of a derrick, the swivel connection tool comprising:

a yoke having a bore therethrough and an opening from a perimeter of the yoke to the bore, the opening sized to receive the tubular through the opening and the bore sized to receive the tubular;

jaws with teeth carried by the yoke and movable with respect to the bore between an open position further from the bore to a tight position closer to the bore configured to hold the tubular in the bore and resist rotation of the tubular in the bore;

an actuator carried by the yoke and operatively coupled to the jaws to move the jaws between the open position and the tight position; and a base carrying the yoke and configured to be carried by the work floor;

wherein the swivel is locatable adjacent the yoke at an incline and an upper end of a tubular of a work string or drill string is locatable in the bore of the yoke with the jaws engaging the upper end of the tubular and resisting rotation of the tubular while the swivel engages the upper end of the tubular.

2. The swivel connection tool of claim 1, wherein the yoke is movably coupled to the base and movable with respect to the base about multiple degrees of freedom, including roll, with the yoke tiltable side to side with respect to the base.

3. The swivel connection tool of claim 1, wherein the yoke is biased to a rest position away from the base, and oriented at an angle between 10-30 degrees with respect to vertical, configured to receive the tubular.

4. The swivel connection tool of claim 1, further comprising:

an arm between the base and the yoke;

a spindle extending from the yoke and to the arm;

the yoke and the spindle movable longitudinally with respect to the arm;

a spring carried by the spindle to bias the yoke away from the base and defining a shock absorber when a tubular is placed in the yoke.

5. The swivel connection tool of claim 1, further comprising an arm coupled between the base and the yoke; and wherein the base further comprises:

a vertical slot receiving the arm therein;

a horizontal slot transverse to the vertical slot;

a pin extending through the horizontal slot, the vertical slot, and the arm;

the pin displacing in the horizontal slot to allow heave movement of the arm and the yoke towards and away from the base; and the arm and the yoke pivoting about the pin to allow pitch movement of the arm and the yoke tilting forward and backward with respect to the base.

6. The swivel connection tool of claim 1, wherein the base further comprises:

a hitch receivable in a receiver, with the hitch carried by one of the base or the work floor, and the receiver carried by the other of the base or the work floor.

7. The swivel connection tool of claim 1, wherein base has a footprint larger than the yoke with a width and a length larger than the yoke configured to resist tipping of the base during use and configured to reduce torque on the work floor during use.

8. The swivel connection tool of claim 1 in combination with a workover rig, the combination comprising:

a derrick disposed on a support surface;

a work floor adjacent the derrick and elevated with respect to the support surface and locatable over a wellhead, the work floor having an opening therein capable of receiving the work string therethrough;

the swivel capable of being selectively and releasably coupled to a tubular of a work string, the swivel capable of rotating the tubular, the swivel being pivotal with respect to the derrick between vertical and inclined with respect to horizontal, the swivel being capable of being raised and lowered by the derrick;

a catwalk on the support surface adjacent to the work floor with a slide extending from the work floor to the catwalk capable of transporting tubulars between the work floor and the catwalk;

the swivel connection tool being located on the work floor with the base of the swivel connection tool being attached to the work floor, and the yoke of the swivel connection tool being located adjacent to an upper end of the slide and between the upper end of the slide and the swivel when the swivel is lowered.

9. The swivel connection tool of claim 1, wherein the jaws are pivotally coupled to the yoke and pivotal between the open position and the tight position.

10. The swivel connection tool of claim 1, wherein the jaws are disposed inside the yoke and outside the bore in the open position.

11. The swivel connection tool of claim 1, wherein the bore defines a bottom of the yoke, and the jaws are located adjacent to the bore at the bottom of the yoke.

12. A method for connecting or disconnecting a threaded connection between a tubular of a work string or drill string and a swivel suspended over an elevated work floor of a derrick, the method comprising:

providing a swivel connection tool comprising:

a yoke having a bore therethrough and an opening from a perimeter of the yoke to the bore;

jaws with teeth carried by the yoke and movable with respect to the bore between an open position further from the bore to a tight position closer to the bore;

an actuator carried by the yoke and operatively couple to the jaws to move the jaws between the open position and the tight position;

a base carrying the yoke and configured to be carried by the work floor;

laying an upper end of a tubular in the bore of the yoke of the swivel connection tool;

gripping the end of the tubular with the jaws of the yoke of the swivel connection tool and resisting rotation of the tubular;

pivoting the swivel to align with the tubular;

rotating an end connection of the swivel with respect to the end of the tubular with the swivel; and releasing the upper end of the tubular from the jaws of the swivel connection tool.

13. The method of claim 12, wherein rotating the end connection of the swivel further comprises breaking a torqued-up connection between the swivel and the tubular.

14. The method of claim 12, wherein rotating the end connection of the swivel further comprises torqueing-up a connection between the swivel and the tubular to a predetermined torque.

15. A swivel connection tool used for connecting a swivel to a tubular, the swivel connection tool comprising:

a yoke having a bore therethrough and an opening from a perimeter of the yoke to the bore, the opening sized to receive the tubular through the opening and the bore sized to receive the tubular;

jaws carried by the yoke and movable with respect to the bore between a an open position further from the bore to a tight position closer to the bore configured to hold the tubular in the bore and resist rotation of the tubular in the bore;

an actuator carried by the yoke and operatively coupled to the jaws to move the jaws between the open position and the tight position;

a base carrying the yoke and configured to be carried by a work floor;

the yoke being oriented at an incline on the base with a bore axis oriented at an acute angle with respect to horizontal;

an arm coupled between the base and the yoke;

a vertical slot in the base receiving the arm therein;

a horizontal slot in the base transverse to the vertical slot;

a pin extending through the horizontal slot, the vertical slot, and the arm, the pin displacing in the horizontal slot to allow heave movement of the arm and the yoke towards and away from the base;

the arm and the yoke pivoting about the pin to allow pitch movement of the arm and the yoke tilting forward and backward with respect to the base; and the arm and the yoke being capable of roll movement with the arm and the yoke tilting side to side with respect to the base.

16. A swivel connection tool for use in connecting or disconnecting a tubular of a work string or drill string to a swivel suspended over an elevated work floor of a derrick, the swivel connection tool comprising:

a yoke having a bore therethrough and an opening from a perimeter of the yoke to the bore, the opening sized to receive the tubular through the opening and the bore sized to receive the tubular;

jaws carried by the yoke and pivotal with respect to the bore from an open position further from the bore to a tight position closer to the bore configured to hold the tubular in the bore and resist rotation of the tubular in the bore;

an actuator carried by the yoke and operatively coupled to the jaws to pivot the jaws between the open position and the tight position;

a base carrying the yoke and configured to be carried by the work floor;

an arm between the base and the yoke;

a spindle extending from the yoke and to the arm;

the yoke and the spindle movable longitudinally with respect to the arm; and a spring carried by the spindle to bias the yoke away from the base and defining a shock absorber when a tubular is placed in the yoke.

17. The swivel connection tool of claim 16, wherein the jaws further comprise teeth configured to engage the tubular and resist rotation of the tubular in the bore.

18. The swivel connection tool of claim 16, further comprising an arm coupled between the base and the yoke, and wherein the base further comprises:

a vertical slot receiving the arm therein;

a horizontal slot transverse to the vertical slot;

a pin extending through the horizontal slot, the vertical slot, and the arm;

the pin displacing in the horizontal slot to allow heave movement of the arm and the yoke towards and away from the base; and the arm and the yoke pivoting about the pin to allow pitch movement of the arm and the yoke tilting forward and backward with respect to the base.

* * * * *